US007311298B2

(12) United States Patent
Giacomini

(10) Patent No.: US 7,311,298 B2
(45) Date of Patent: Dec. 25, 2007

(54) INTEGRATED AIR COMPRESSOR AND WINCH

(75) Inventor: Thomas W. Giacomini, Portland, OR (US)

(73) Assignee: Warn Industries, Inc., Milwaukie, OR (US)

( * ) Notice: Subject to any disclaimer, the term of this patent is extended or adjusted under 35 U.S.C. 154(b) by 142 days.

(21) Appl. No.: 11/149,492

(22) Filed: Jun. 9, 2005

(65) Prior Publication Data

US 2006/0278860 A1 Dec. 14, 2006

(51) Int. Cl.
*B66D 1/00* (2006.01)

(52) U.S. Cl. ..... 254/323; 254/361

(58) Field of Classification Search ..... 254/323, 254/361, 328

See application file for complete search history.

(56) References Cited

U.S. PATENT DOCUMENTS

| | | | | |
|---|---|---|---|---|
| 3,986,588 | A | 10/1976 | Kuzarov | |
| 4,004,780 | A | 1/1977 | Kuzarov | |
| 4,033,552 | A | 7/1977 | Kuzarov | |
| 4,047,311 | A * | 9/1977 | Kelley | 37/309 |
| 4,162,713 | A * | 7/1979 | Heitman et al. | 180/242 |
| 4,185,520 | A * | 1/1980 | Henneman et al. | 475/83 |
| 4,441,690 | A | 4/1984 | Koopmans | |
| 4,444,273 | A | 4/1984 | Ruby | |
| 4,448,398 | A * | 5/1984 | Wyatt | 254/361 |
| 4,461,460 | A | 7/1984 | Telford | |
| 4,482,133 | A | 11/1984 | Bishop | |
| 4,545,567 | A | 10/1985 | Telford et al. | |
| 4,736,929 | A | 4/1988 | McMorris | |
| 4,746,100 | A * | 5/1988 | Davenport et al. | 254/379 |
| 5,261,646 | A | 11/1993 | Telford | |
| 5,482,255 | A | 1/1996 | Daschel et al. | |
| 5,720,400 | A | 2/1998 | Altizer, Sr. | |
| 5,794,920 | A | 8/1998 | Kronberger | |
| 5,842,684 | A * | 12/1998 | Aho | 254/344 |
| 5,887,815 | A * | 3/1999 | Pierce | 242/386 |
| 5,997,426 | A | 12/1999 | Ito et al. | |
| 6,012,707 | A * | 1/2000 | Enlund | 254/361 |
| 6,357,159 | B1 * | 3/2002 | Bowling | 43/2 |
| 6,371,449 | B1 | 4/2002 | Chamberlain | |
| 6,604,731 | B2 | 8/2003 | Hodge | |
| 6,658,852 | B2 | 12/2003 | Frey | |
| 6,695,566 | B2 | 2/2004 | Rodriguez Navio | |
| 7,063,306 | B2 * | 6/2006 | Sanders et al. | 254/361 |
| 2003/0164256 | A1 | 9/2003 | Murray et al. | |
| 2004/0134175 | A1 | 7/2004 | Osborne | |

FOREIGN PATENT DOCUMENTS

| | | |
|---|---|---|
| GB | 750967 | 6/1956 |
| WO | 2004026753 | 4/2004 |

* cited by examiner

*Primary Examiner*—Emmanuel M Marcelo
(74) *Attorney, Agent, or Firm*—Harness, Dickey & Pierce, P.L.C.

(57) ABSTRACT

An integrated air compressor and winch is provided that utilizes a single source of rotary motive power for driving both a winch drum and compressor mechanism. The integrated air compressor and winch is preferably provided with a gear case that is operable to provide an appropriate gear reduction for driving the winch drum while providing an appropriate drive speed for operating the compressor.

27 Claims, 2 Drawing Sheets

INTEGRATED AIR COMPRESSOR AND WINCH

FIELD OF THE INVENTION

The present invention relates to an integrated air compressor and winch mechanism.

BACKGROUND AND SUMMARY OF THE INVENTION

Winches have been commonly mounted to a support bracket at the front bumper location of an automobile, and have been used to perform a variety of tasks, such as dragging a large object while the vehicle is stationary, or moving the vehicle itself by attaching the free end of the winch cable to a stationary object and reeling in the cable to pull the vehicle toward that object. These typical winches include a cable winding drum supported on each end and including an electric or hydraulic motor in combination with a speed reducing gear transmission for transmitting torque to the cable winding drum. The use of winches with off-road and utility vehicles has greatly enhanced the functionality of the vehicles. However, it is still desirable to further enhance the vehicle functionality, as well as the functionality of the winch.

The present invention provides an integrated air compressor and winch system that uses a common drive motor for driving both the winch drum and the air compressor mechanism so as to enhance the functionality of the winch as it is used on a vehicle, or as is used in other industrial applications. The present invention utilizes a source of rotary motive power such as an electric motor, hydraulic motor, or internal combustion engine that is used in combination with a drum mechanism selectively engageable with the source of rotary motive power having a cable adapted to be wound onto and off from the drum mechanism, and a compression mechanism selectively engageable with the source of rotary motive power. The compression mechanism is capable of generating stored compressed gasses or alternatively stored vacuum.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
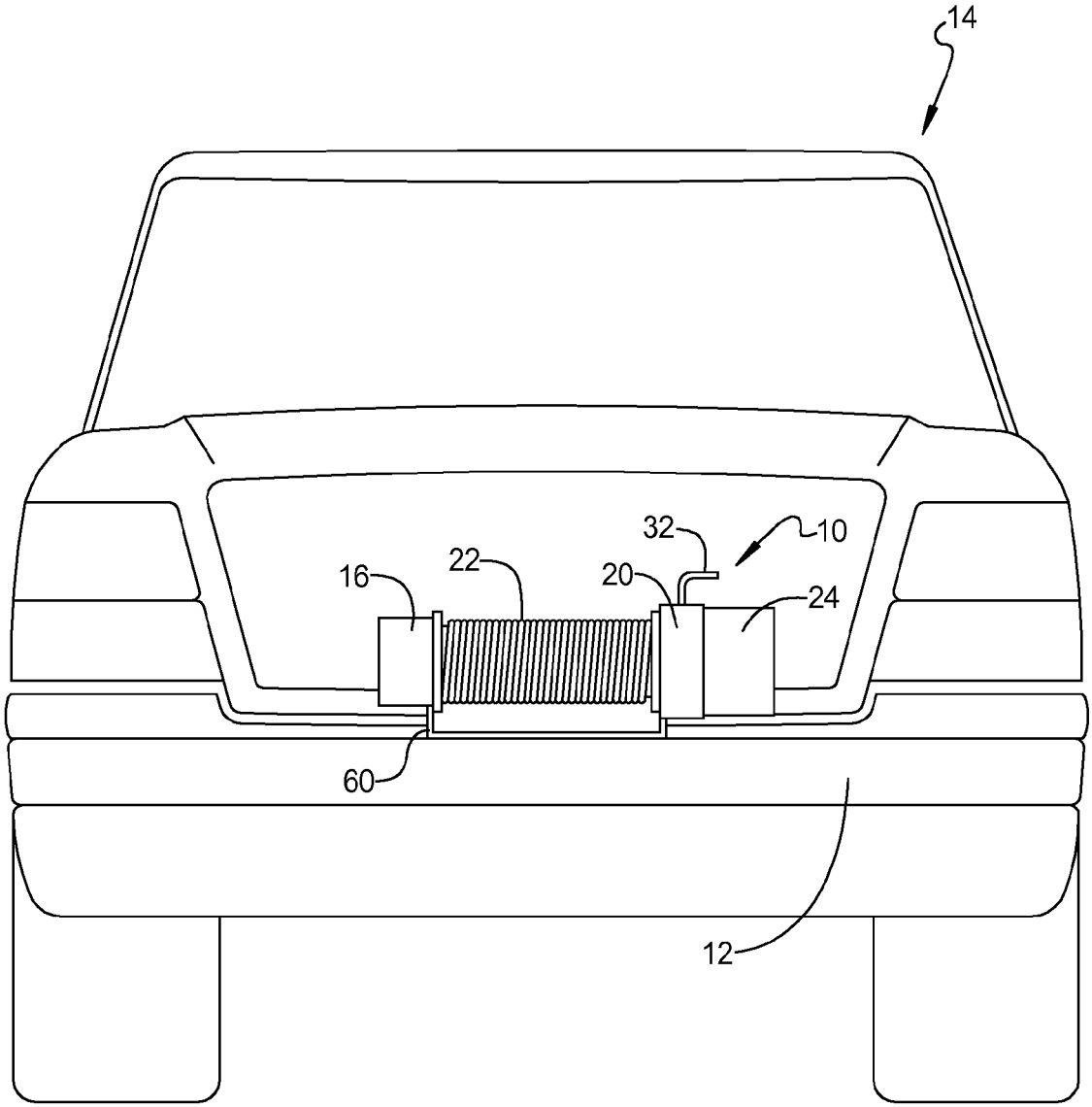
FIG. 1 illustrates an integrated air compressor and winch according to the principles of the present invention.

With reference to FIG. 1, the integrated air compressor and winch 10 is shown mounted to a front bumper 12 of a vehicle 14. The integrated air compressor and winch includes an electric motor 16 which has an output shaft 18 engaged with a switchable gear case 20 that is selectively operable by shift mechanism 32 to provide driving torque to the winch drum 22 or to compressor mechanism 24.

Figure 2:
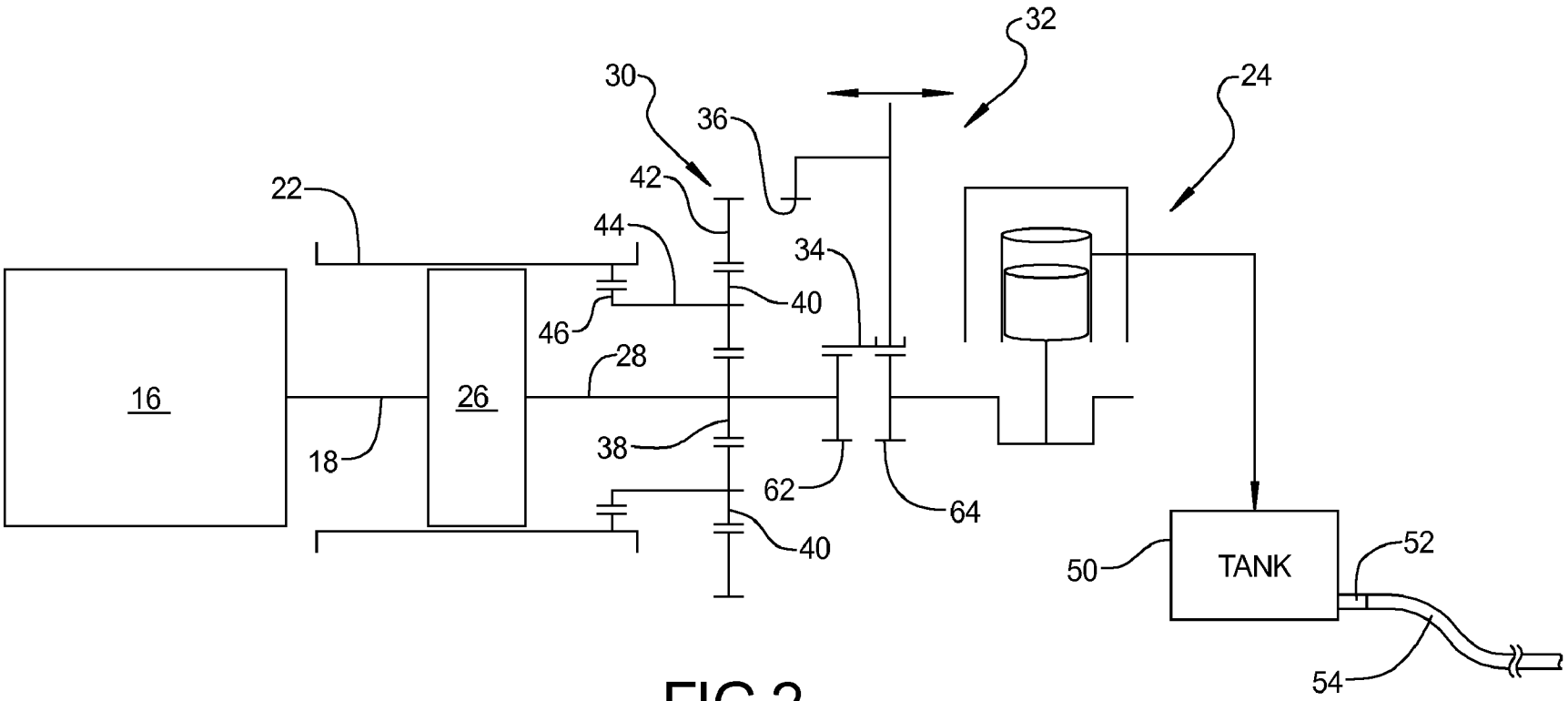
FIG. 2 is a schematic diagram of the integrated air compressor and winch mechanism according to the principles of the present invention.

The motor 16 serves as a source of rotary motive power and can include an electric motor, hydraulic motor, internal combustion engine, or other known sources of rotary motive power. As illustrated in FIG. 2, the motor 16 has an output shaft 18 that preferably supports a brake device 26. The brake device can be of the type shown in commonly assigned U.S. Pat. Nos. 4,461,460; 5,482,255; 4,545,567; or 5,261,646 all of which are herein incorporated by reference. In addition, other brake mechanisms known in the art could also be utilized with this system.

The gear case 20 receives drive torque from intermediate shaft 28 which is connected to the brake device 26. The gear case 20 can include a planetary reduction gear system 30 that is selectively operable by shift mechanism 32 to provide drive torque to the drum 22. The shift mechanism 32 can also be operable to engage the intermediate shaft 28 for direct engagement with the compressor mechanism 24 by movement of coupler sleeve 34. The gear reduction mechanism 30 can be of any known type of reduction gearing and can include a single planetary gear system as shown or a multiple planetary gear system as shown in commonly assigned U.S. Pat. Nos. 4,545,567; 4,461,460; 4,736,929; 5,261,646, which are all herein incorporated by reference. The planetary gear mechanism 30, as shown, is provided with a sun gear 38 fixed for rotation with intermediate shaft 28. A plurality of planetary gears 40 are in meshing engagement with the sun gear 38 and with an annular ring gear 42. The planetary gears 40 are supported by a planetary carrier 44 which is provided with a splined connection to the drum 22 at 46. The clutch mechanism 36 is engageable with the annular ring gear 42 to prevent rotation thereof in order to cause rotation of the planet carrier 44 when the sun gear 38 is rotated. When the annular ring gear 42 is not engaged by the shift mechanism 32, the ring gear 42 is free to rotate along with rotation of the sun gear 38 and planet gears 40 so that no appreciable torque is applied to the planet carrier 44 and thus, no rotation is imparted to the drum 22. The shift mechanism 32 is designed to allow torque to be applied either to the drum 22 or compressor 24 depending upon the position of the shift mechanism 32. For driving the compressor 24, the shift mechanism 32 moves coupler 34 into simultaneous engagement with splined member 62 (connected to intermediate shaft 28) and splined member 64 (connected to compressor 24).

The compressor mechanism 24 can be of any known compressor type, including piston, rotary vane, and scroll-type compressors, as well as other known compressors. The compressor 24 includes a storage tank or vessel 50 that receives compressed air or vacuum from the compression mechanism and stores the compressed air or vacuum for subsequent use. The storage tank 50 includes a compressor hose fitting 52 which is releasably engageable with a compressor hose 54. Furthermore, the compressor 24 includes a pressure regulator and other valving and controls typically associated with compressors.

The integrated air compressor and winch is mounted on a common support 60 which can be mounted to a vehicle or used in other industrial applications. In the embodiment shown, the motor 16 is disposed on one side of the drum 22 while the gear case 20 and compressor 24 are mounted on the opposite side of the drum 22. It should be understood that other variations of this arrangement could also be utilized in which the motor 16, gear case 20, and compressor 24 can all be mounted on the same side, or wherein the motor and gear case can be mounted on one side with the compressor on the other, or with the motor and compressor on one side with the gear case on the other. Furthermore, other configurations with the motor and/or compressor being non-coaxially mounted with the drum can also be utilized.

The integrated air compressor and winch 10 of the present invention provides for enhanced functionality for both a winch mechanism and for a vehicle utilizing the integrated air compressor and winch. The use of a single source of rotary motive power for operating both the winch drum and compressor provides improved efficiency as compared to a separate winch and compressor which each would require their own motor and related power source.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An apparatus, comprising:

a source of rotary motive power;

a drum mechanism selectively engageable with said source of rotary motive power so as to be selectively driven by said source of rotary motive power;

a cable adapted to be wound onto and off from said drum mechanism;

an air compressor mechanism selectively engageable with said source of rotary motive power so as to be driven by said source of rotary motive power;

wherein said source of rotary motive power, said drum mechanism and said air compressor mechanism are mounted on a common support.

2. The apparatus according to claim 1, wherein said source of rotary motive power is an electric motor.

3. The apparatus according to claim 1, further comprising a drive mechanism operable for selectively providing drive torque from said source of rotary motive power to said drum mechanism.

4. The apparatus according to claim 3, wherein said drive mechanism includes a gear reduction mechanism.

5. The apparatus according to claim 1, further comprising a drive mechanism operable for selectively providing drive torque from said source of rotary motive power to said air compressor mechanism.

6. The apparatus according to claim 5, wherein said drive mechanism includes a clutch mechanism.

7. The apparatus according to claim 1, further comprising a drive mechanism operable for selectively providing drive torque from said source of rotary motive power to said drum mechanism and said air compressor mechanism.

8. The apparatus according to claim 1, wherein said source of rotary motive power is mounted on one side of said drum mechanism and said air compressor mechanism is mounted on an opposite side of said drum mechanism.

9. The apparatus according to claim 8, further comprising a drive shaft extending through said drum mechanism and providing driving torque from said source of rotary motive power to said air compressor mechanism.

10. The apparatus according to claim 1, wherein said air compressor mechanism includes a storage vessel for containing pressurized air.

11. The apparatus according to claim 1, wherein said air compressor mechanism includes an outlet fitting to which a compressor hose is releasably connected.

12. The apparatus according to claim 1, wherein said air compressor mechanism includes a storage vessel for containing a vacuum.

13. The apparatus according to claim 1, wherein said common support is adapted to be mounted to a vehicle.

14. An apparatus, comprising:

a source of rotary motive power;

a drum mechanism engaged with said source of rotary motive power so as to be driven by said source of rotary motive power;

a cable adapted to be wound onto and off from said drum mechanism;

an air compressor mechanism selectively engageable with said source of rotary motive power so as to be selectively driven by said source of rotary motive power;

wherein said source of rotary motive power, said drum mechanism and said air compressor mechanism are mounted on a common support.

15. The apparatus according to claim 14, wherein said source of rotary motive power is an electric motor.

16. The apparatus according to claim 14, further comprising a drive mechanism operable for selectively providing drive torque from said source of rotary motive power to said air compressor mechanism.

17. The apparatus according to claim 16, wherein said drive mechanism includes a coupling mechanism.

18. The apparatus according to claim 14, wherein said common support is adapted to be mounted to a vehicle.

19. An apparatus, comprising:

a source of rotary motive power;

a drum mechanism selectively engageable with said source of rotary motive power so as to be selectively driven by said source of rotary motive power;

a cable adapted to be wound onto and off from said drum mechanism;

an air compressor mechanism engaged with said source of rotary motive power so as to be driven by said source of rotary motive power;

wherein said source of rotary motive power, said drum mechanism and said air compressor mechanism are mounted on a common support.

20. The apparatus according to claim 19, wherein said source of rotary motive power is an electric motor.

21. The apparatus according to claim 19, further comprising a drive mechanism operable for selectively providing drive torque from said source of rotary motive power to said drum mechanism.

22. The apparatus according to claim 21, wherein said drive mechanism includes a gear reduction mechanism.

23. The apparatus according to claim 22, wherein said drive mechanism further includes a clutch mechanism.

24. The apparatus according to claim 19, wherein said common support is adapted to be mounted to a vehicle.

25. An apparatus, comprising:

an electric motor;

a drum mechanism selectively engageable with said electric motor, said electric motor being disposed on a first side of said drum mechanism;

a cable adapted to be wound onto and off from said drum mechanism; and an air compressor mechanism disposed on a second side of said drum mechanism opposite to said first side and adapted to be driven by said electric motor.

26. The apparatus according to claim 25, wherein said electric motor, said drum mechanism, and said air compressor mechanism are mounted on a common support.

27. The apparatus according to claim 26, wherein said common support is adapted to be mounted to a vehicle.

* * * * *